US006439019B1

(12) United States Patent
Heimann et al.

(10) Patent No.: US 6,439,019 B1
(45) Date of Patent: Aug. 27, 2002

(54) ROLLER CAGE FOR A DEEP ROLLING WORK ROLLER

(75) Inventors: Alfred Heimann, Archen; Hans Zimmerman, Selfkant, both of (DE)

(73) Assignee: Hegenscheidt-MFD GmbH Co. KG, Erkelenz (DE)

( * ) Notice: Subject to any disclaimer, the term of this patent is extended or adjusted under 35 U.S.C. 154(b) by 0 days.

(21) Appl. No.: 09/747,861

(22) Filed: Dec. 22, 2000

(30) Foreign Application Priority Data

Sep. 12, 2000 (DE) ..... 100 45 258

(51) Int. Cl.[7] ..... B21D 15/00

(52) U.S. Cl. ..... 72/110; 72/41; 72/42; 384/463

(58) Field of Search ..... 72/41, 42, 110, 72/236; 384/463, 464, 470, 523, 527

(56) References Cited

U.S. PATENT DOCUMENTS

| | | | | |
|---|---|---|---|---|
| 5,328,277 A | * | 7/1994 | Moulton | 384/572 |
| 5,816,713 A | * | 10/1998 | Prock et al. | 384/580 |
| 5,860,747 A | * | 1/1999 | Wan et al. | 384/463 |
| 6,007,251 A | * | 12/1999 | Hayashida et al. | 384/492 |
| 6,238,744 B1 | * | 5/2001 | Magoulick et al. | 427/369 |

* cited by examiner

*Primary Examiner*—Ed Tolan
(74) *Attorney, Agent, or Firm*—Carlson, Gaskey & Olds

(57) ABSTRACT

A roller cage (6) is provided for a minimum of one work roller (3) of a tool for deep rolling of grooves or radii of a crankshaft bearing (1) where the work roller (3) at a section of its circumference is loosely guided by the roller cage (6) or inside a concave void of the roller cage (6). Portions of the roller cage (6) by which the work roller (3) is guided, consist of a material that dispenses solid lubricant to the work roller (3).

17 Claims, 1 Drawing Sheet

ROLLER CAGE FOR A DEEP ROLLING WORK ROLLER

RELATED APPLICATIONS

This application claims priority to German Patent Application No. 10045258.2, filed Sep. 12, 2000.

BACKGROUND OF THE INVENTION

The invention concerns a roller cage for a minimum of one work roller of a tool for deep rolling of grooves or radii of crankshaft bearings, where the work roller is loosely guided at a section of its circumference, either by the roller cage or in a concave recess of the roller cage.

A prior art deep rolling tool is described in European Patent Application EP 0 839 607 A1. Deep rolling work rollers typically are loosely guided in roller cages identified by reference number 15. The roller cages are attached to the external end of the long leg of an L-shaped tool holder.

The deep rolling work rollers are described in U.S. Pat. No. 5,806,184. The work rollers are guided in roller cages. Work rollers for the deep rolling of grooves or radii of crankshaft bearings are highly stressed tools. Their wear and tear occurs, for example, by material chipping similar to that experienced in gears or in rolling elements of rolling bearings.

In a deep rolling tool known in the art, the work roller is vertically supported from above by one guide roller each. The total load applied to the work roller is generated by the contacts between thy work roller, the guide roller, the crankshaft and the roller cage. Of the two roller cages, each located opposite one work roller, only the one located in the crankshaft drive direction is subject to wear. A generally known practice for reduction of this wear and tear is to offset the work roller by a small amount, relative to a line formed by the crankshaft axis and the guide roller.

Work rollers are, however, not only stressed by pressure, but there is also slippage between the work roller, the crankshaft and the guide roller, since their effective radii roll off differently. The roller cage transfers the so generated rolling force directly to the work roller and is, for this reason, severely stressed by the slipping action, and wears fast accordingly. Previously this type of wear has been counteracted by applying oil lubrication or oil-air-lubrication using rolling oil, to the deep rolling tools. For oil lubrication a thin-bodied oil (5 CST) is used feeding very generous amounts.

SUMMARY OF THE INVENTION

The object of the invention calls for a reduction of wear for the roller cage. The means used for this purpose,should be easy to handle, reliable in operation, and also reasonably priced.

The object of the invention is attained in that at least those portions of the roller cage, or those sections of the concave recess at which, or in which, the work roller is guided in the roller cage, consist of a material that dispenses solid lubricant to the work roller. One suitable material of this type is, for example, graphite. A block of graphite is placed in a void of the roller cage and, during deep rolling, dispenses graphite particles to the work roller to provide lubrication.

Wear and tear of the graphite-holding portion of the roller cage is controlled in a simple manner by dimensioning the remaining portions of the roller cage not containing graphite, small enough to allow at all times a sufficiently large graphite layer to be removed along with their wear. These relationships are determined from case to case experimentally.

Materials other than graphite may also be utilized as a solid lubricant, such as $MOS_2$. Also, the application of a sintered metal material for the roller cage may be considered. The porosity of the sintered metal material supports the application of a lubricant under external pressure. The lubricant passes through the sintered metal material and exits at places where the roller cage is in contact with the work roller.

BRIEF DESCRIPTION OF THE DRAWING

In the following the invention is described in more detail based on one embodiment. In a very simplified and schematic view the following is shown.

DETAILED DESCRIPTION OF THE PREFERRED EMBODIMENT

Figure 1:
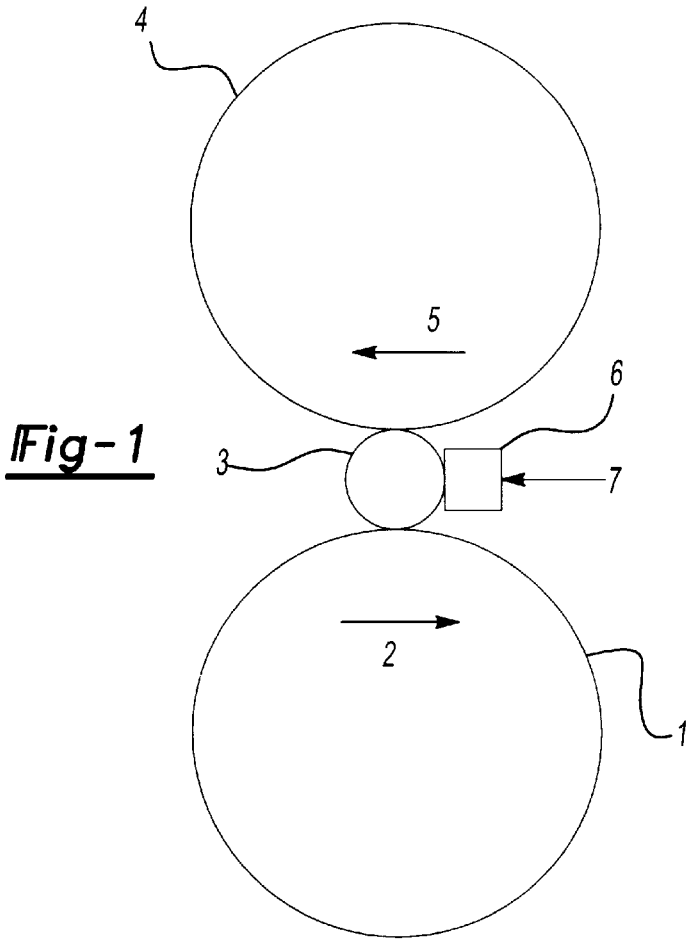
FIG. 1 a side view of the engaged components of a deep rolling tool.
Figure 2:
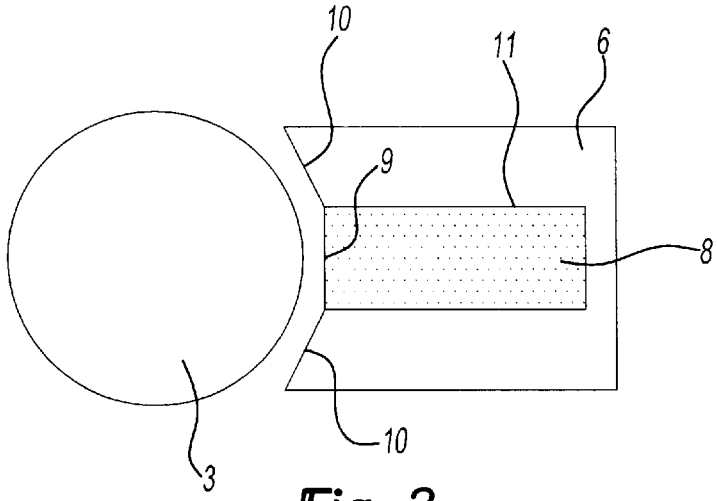
FIG. 2 a roller cage containing a lubricant dispensing element.

Number 1 in FIG. 1 refers to a circle representing the circumference of a bearing of a crankshaft. The crankshaft 1 rotates in the direction of the arrow 2. A deep rolling work roller 3 engages a groove (not shown) of the crankshaft 1. In the vertical direction the work roller 3 is supported from above by a supporting roller 4 which, in turn, rotates in the direction of the arrow. 5. The working roller 3 is loosely guided by a roller cage 6 which contacts the work roller 3 in the direction of the arrow 7. The area of contact between the work roller 3 and the roller cage 6 is shown enlarged in FIG. 2. The roller cage 6 contains a void 11. A graphite block 8 is inserted in the void 11, representing the direct contact between the roller cage 6 and the work roller 3. The relationship of the contact area 9, between the face of the graphite block 8 and the work roller 3 and the surfaces 10 of the wall of the roller cage 6 laterally supporting the graphite block 8, is designed so that in the course of wear of the roller cage 6 a sufficient amount of graphite can be transferred to the work roller 3 from the graphite block 8 at all times. The specific ratio of the surface areas under consideration is determined experimentally.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A deep rolling tool for rolling the grooves on crankshaft journals comprising:

a cage having a recess and a pocket proximate said recess;

a work roller received by said recess; and a solid lubricant material insert disposed in said pocket and adjacent said work roller for lubricating said work roller.

2. The tool according to claim 1, wherein said cage is constructed from metal.

3. The tool according to claim 2, wherein said metal is bronze.

4. The tool according to claim 1, wherein said solid lubricant material insert is graphite.

5. The tool according to claim 1, wherein said cage is a sintered metal.

6. The tool according to claim 5, wherein pressurized lubricant is applied to said cage.

7. The tool according to claim 1, wherein said solid lubricant material insert is a sintered metal.

8. The tool according to claim 7, wherein pressurized lubricant is applied to said solid lubricant material insert.

9. The tool according to claim 1, wherein the recess is generally concave.

10. The tool according to claim 1, wherein the pocket extends into said cage generally perpendicular to a plane tangential to said work roller.

11. The tool according to claim 1, wherein said recess includes surfaces without said solid lubricant on opposing sides immediately adjacent to said pocket.

12. The tool according to claim 11, wherein said surfaces are spaced a first distance from said work roller and said solid lubricant is spaced a second distance from said work roller less than said first distance.

13. A deep rolling tool for rolling the grooves on crankshaft journals comprising:

a supporting roller;

a crankshaft journal spaced from said supporting roller;

a cage adjacent to said supporting roller and including a recess with a pocket extending into said cage from said recess;

a work roller received by said recess and engaging said supporting roller and said crankshaft journal; and a solid lubricant material insert disposed in said pocket and adjacent said work roller for lubricating said work roller.

14. The tool according to claim 13, wherein the recess is generally concave.

15. The tool according to claim 13, wherein the pocket extends into said cage generally perpendicular to a plane tangential to said work roller.

16. The tool according to claim 13, wherein said recess includes surfaces without said solid lubricant on opposing sides immediately adjacent to said pocket.

17. The tool according to claim 16, wherein said surfaces are spaced a first distance from said work roller and said solid lubricant is spaced a second distance from said work roller less than said first distance.

* * * * *